US009845613B1

(12) United States Patent
Leu et al.

(10) Patent No.: US 9,845,613 B1
(45) Date of Patent: Dec. 19, 2017

(54) SIDEWALL ATTACHMENT SYSTEM

(71) Applicant: 4D Tents, LLC, Wheat Ridge, CO (US)

(72) Inventors: Kimberly Leu, Wheat Ridge, CO (US); Charles E. O'Reilly, Wheat Ridge, CO (US)

(73) Assignee: 4D Tents, LLC, Wheat Ridge, CO (US)

( * ) Notice: Subject to any disclaimer, the term of this patent is extended or adjusted under 35 U.S.C. 154(b) by 0 days.

(21) Appl. No.: 15/185,826

(22) Filed: Jun. 17, 2016

(51) Int. Cl.
*E04H 15/00* (2006.01)
*E04H 15/54* (2006.01)
*E04H 15/64* (2006.01)

(52) U.S. Cl.
CPC ..... *E04H 15/008* (2013.01); *E04H 15/54* (2013.01); *E04H 15/64* (2013.01)

(58) Field of Classification Search
CPC ..... E04H 15/008; E04H 15/64; E04H 15/54
USPC ..... 160/123, 124, 354, 368.1, 84.04
See application file for complete search history.

(56) References Cited

U.S. PATENT DOCUMENTS 5,651,407 A * 7/1997 Perez ..... A47H 13/00 160/330
5,768,722 A * 6/1998 Olson ..... A47C 19/20 135/119
6,038,749 A * 3/2000 Eberhardt ..... A47H 13/16 16/87.2
6,059,005 A * 5/2000 Zinbarg ..... E06B 3/7001 160/329
6,478,039 B2 * 11/2002 Suh ..... E04H 15/50 135/120.3
6,752,164 B1 6/2004 Park
7,461,485 B2 * 12/2008 Toledo ..... A47F 3/002 135/114
7,650,899 B2 1/2010 Eastman, II
7,699,091 B2 4/2010 Fisher, Sr.
7,963,295 B2 * 6/2011 Li ..... E04H 15/16 135/120.2
8,316,508 B2 * 11/2012 Lapping ..... E04H 15/18 135/121
8,826,927 B1 * 9/2014 Beam ..... E04H 15/001 135/115
2006/0021643 A1 * 2/2006 Brensinger ..... E04H 15/56 135/90
2006/0042673 A1 * 3/2006 Tseng ..... A47H 13/00 135/117

(Continued)

*Primary Examiner* — Noah Chandler Hawk
(74) *Attorney, Agent, or Firm* — Neustel Law Offices

(57) ABSTRACT

A sidewall attachment system for attaching decorative objects such as decorative flowers to a structure such as a tent to create a decorative display such as a flower wall. The sidewall attachment system generally includes a sidewall which is adapted to be removably secured to a structure such as a tent. The sidewall includes mounts and apertures for removably securing the upper end and sides, respectively, of the sidewall to the structure. The sidewall also includes a plurality of retainer strips adapted to removably engage with corresponding connector strips located on each of a plurality of panels adapted to be removably connected to the sidewall. Each of the panels includes a plurality of openings which function as grommets to retain any number of decorative attachments such as flowers to the panels to form a decorative display on the structure.

18 Claims, 10 Drawing Sheets

(56) References Cited

U.S. PATENT DOCUMENTS

| | | | | |
|---|---|---|---|---|
| 2006/0248641 | A1* | 11/2006 | Kinstle | A47K 3/38 4/608 |
| 2007/0039639 | A1* | 2/2007 | Duncan | E04H 9/10 135/97 |
| 2009/0095337 | A1* | 4/2009 | Carter | E04H 15/50 135/143 |
| 2010/0116446 | A1* | 5/2010 | Willett | E04H 17/066 160/368.1 |
| 2010/0269312 | A1 | 10/2010 | Wagner | |
| 2011/0168340 | A1* | 7/2011 | Squillante | A47H 2/00 160/330 |
| 2016/0017631 | A1* | 1/2016 | Gilmore | E04H 15/36 135/143 |

* cited by examiner

SIDEWALL ATTACHMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a sidewall attachment system for attaching decorative objects such as decorative flowers to a structure such as a tent to create a decorative display such as a flower wall.

Related Art

Any discussion of the related art throughout the specification should in no way be considered as an admission that such related art is widely known or forms part of common general knowledge in the field.

Flower walls and the like are popular at various gatherings and functions such as weddings. In the past, one desiring such a decorative display would be required to manually connect decorative attachments to their tent or other structure. Since such tents and structures are generally rented for such gatherings, there can be a significant risk that the rented property may be damaged. It can also be extremely inefficient to manually connect such decorative objects individually without damaging the underlying structure.

SUMMARY

An example embodiment of the present invention is directed to a sidewall attachment system. The sidewall attachment system includes a sidewall which is adapted to be removably secured to a structure such as a tent. The sidewall includes mounts and apertures for removably securing the upper end and sides, respectively, of the sidewall to the structure. The sidewall also includes a plurality of retainer strips adapted to removably engage with corresponding connector strips located on each of a plurality of panels adapted to be removably connected to the sidewall. Each of the panels includes a plurality of openings which function as grommets to retain any number of decorative attachments such as flowers to the panels to form a decorative display on the structure.

There has thus been outlined, rather broadly, some of the features of the sidewall attachment system in order that the detailed description thereof may be better understood, and in order that the present contribution to the art may be better appreciated. There are additional features of the sidewall attachment system that will be described hereinafter and that will form the subject matter of the claims appended hereto. In this respect, before explaining at least one embodiment of the sidewall attachment system in detail, it is to be understood that the sidewall attachment system is not limited in its application to the details of construction or to the arrangements of the components set forth in the following description or illustrated in the drawings. The sidewall attachment system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
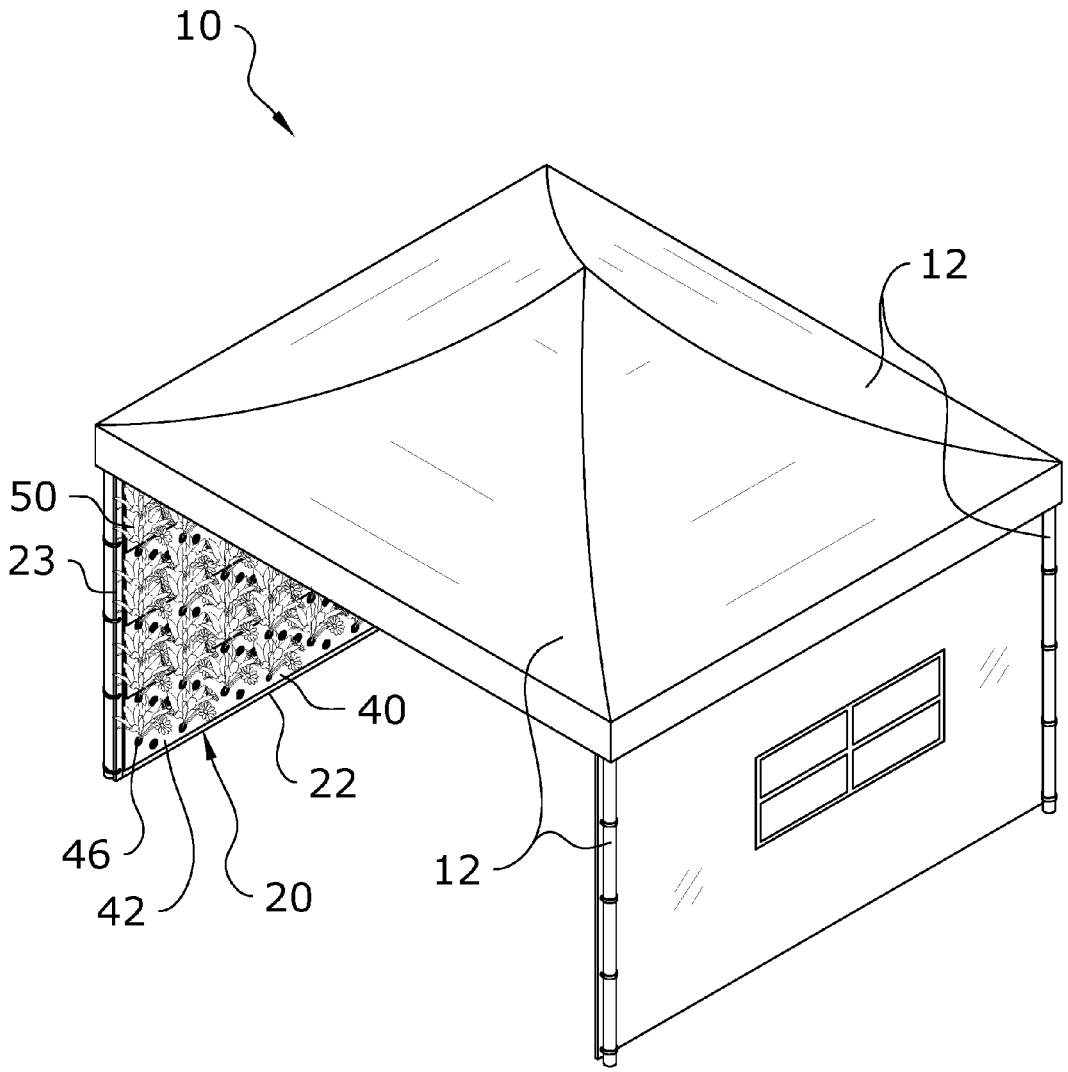
FIG. 1 is a perspective view of a sidewall attachment system in accordance with an example embodiment.

An example sidewall attachment system generally comprises a sidewall 20 which is adapted to be removably secured to a structure 12 such as a tent. The sidewall 20 includes mounts 30 and apertures 32 for removably securing the upper end 21 and sides 23, 24, respectively, of the sidewall 20 to the structure 12. The sidewall 20 also includes a plurality of retainer strips 34 adapted to removably engage with corresponding connector strips 45 located on each of a plurality of panels 40 adapted to be removably connected to the sidewall 20. Each of the panels 40 includes a plurality of openings 46 which function as grommets to retain any number of decorative attachments 50 such as flowers to the panels 40 to form a decorative display on the structure 12.

B. Sidewall

As shown throughout the figures, an exemplary embodiment of the present invention comprises a sidewall 20 which is adapted to be removably attached to a structure 12 such as a tent. Although the figures illustrate the structure 12 as comprising a tent, it should be appreciated that the sidewall may be attached to various other structures 12, including buildings such as homes or businesses, vehicles, and the like.

Although the figures illustrate that the sidewall 20 is attached to an inner surface of the structure 12, it should be appreciated that the sidewall 20 could be attached to an outer surface of the structure 12 as well. For example, with respect to the tent shown in FIG. 1, the sidewall 20 could be attached to an outer wall of the tent rather than the inner wall as shown in the exemplary figure.

The sidewall 20 may comprise various shapes, sizes, and orientations and thus should not be limited with regard to those characteristics based on the exemplary figures or description herein. In the exemplary figures, a sidewall 20 comprising a rectangular shape having an upper end 21, a lower end 22, a first side 23, a second side 24, an outer surface 25, and an inner surface 26 is shown. The number of ends 21, 22 and/or sides 23, 24 of the sidewall 20 will vary in different embodiments and for different applications.

Figure 2:
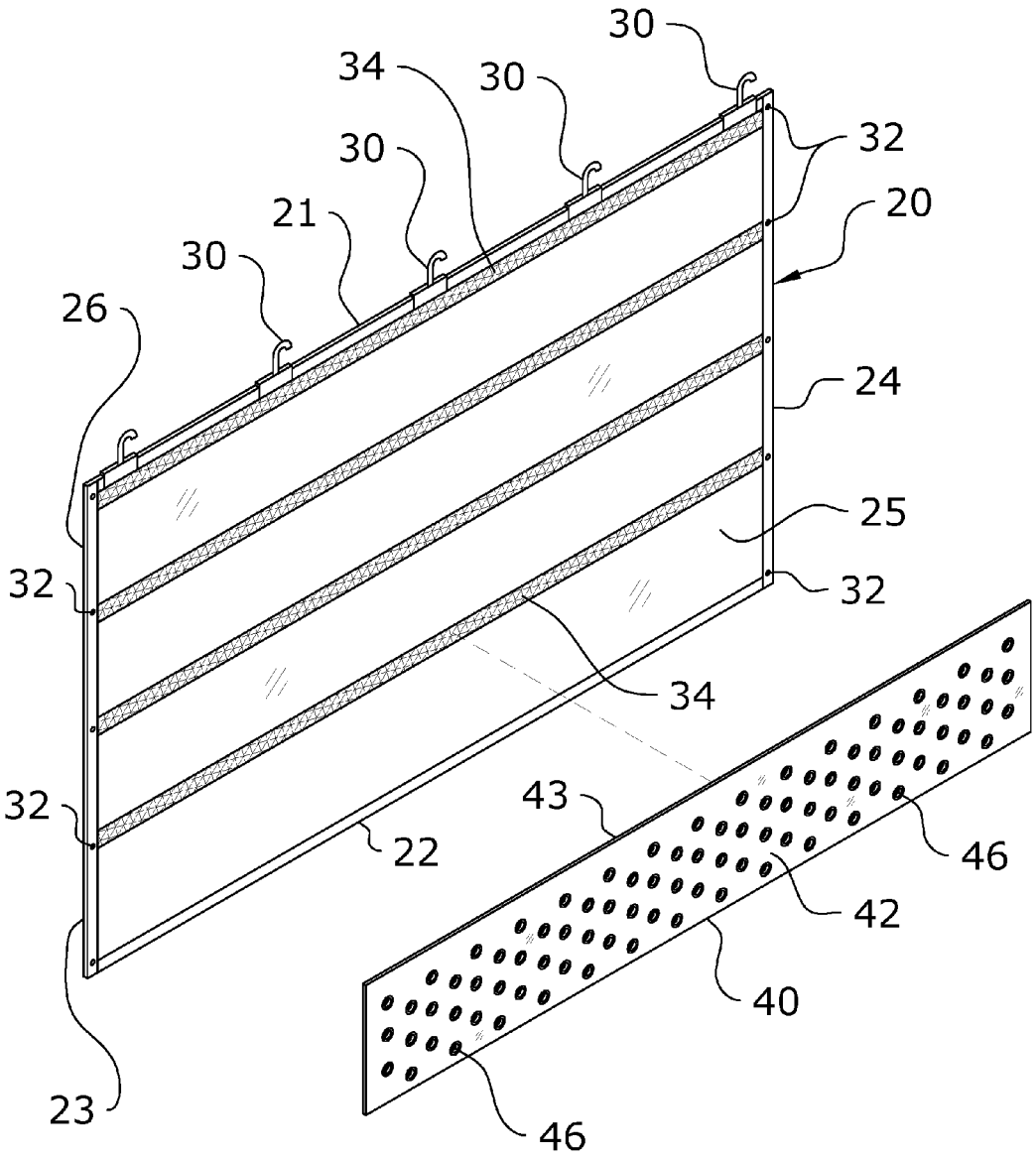
FIG. 2 is an upper perspective view of a panel aligned for connection to a sidewall.

FIG. 2 best illustrates a sidewall 20 for use with the present invention. As shown, the sidewall includes a plurality of mounts 30 on its upper end 21 which may be utilized to removably secure the sidewall 20 to the structure 12. In the exemplary figures, the sidewall 20 is shown as being suspended from the upper end 21 of the sidewall 20, though other methods may be used for connecting the sidewall 20 to the structure 12.

The mounts 30 may comprise any structure capable of removably connecting the sidewall 20 to the structure 12. In some embodiments, the sidewall 20 may be more fixedly secured to the structure 12, such as by nailing or use of an adhesive. In the embodiment shown in the figures, which is not in any manner limiting, the mounts 30 are shown as comprising hooks which extend from the upper end 21 of the sidewall 20 such that they may be positioned over the upper end of a wall or vertical surface of the structure 12.

For additional stability and to ensure that the sidewall 20 does not flap in the wind, the sides 23, 24 of the sidewall 20 may also be secured against the structure 12. In the exemplary embodiment shown in the figures, the sides 23, 24 of the sidewall 20 each include a vertical row of apertures 32 through which ties such as cords or ropes may be extended and tied off to secure the sides 23, 24 of the sidewall 20 to the structure 12 as shown in FIG. 1. Alternatively, the sidewall 20 could be tied to another sidewall 20.

Figure 3:
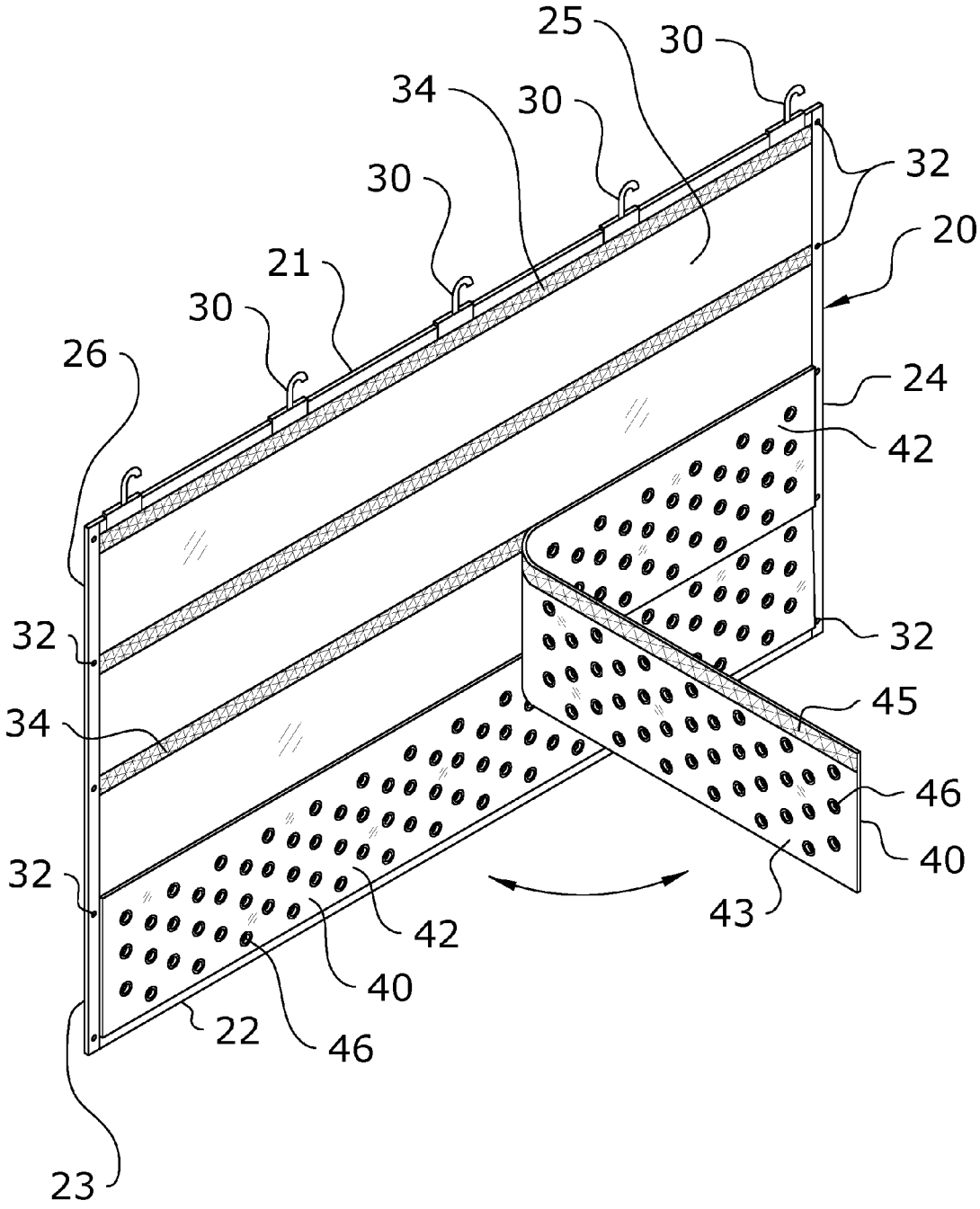
FIG. 3 is an upper perspective view of panels being connected to a sidewall.

As best shown in FIGS. 2-3, the sidewall 20 includes a plurality of retainer strips 34 which are adapted to removably engage with corresponding connector strips 45 on the panels 40 when the panels 40 are connected to the sidewall 20. In the figures, the retainer strips 34 are shown as extending across the outer surface 25 of the sidewall 20 between its first side 23 and its second side 24. In some embodiments, the retainer strips 34 could extend across the inner surface 26 of the sidewall 20 in addition to or instead of extending across the outer surface 25.

The retainer strips 34 may comprise adhesive strips or hook-and-fastener loop strips extending across the sidewall 20. The retainer strips 34 may extend in parallel relationship with each other, or other orientations may be utilized. Although the retainer strips 34 are shown as being horizontally oriented between the sides 23, 24 of the sidewall 20, they could be diagonally oriented or vertically oriented between any of the ends 21, 22 or sides 23, 24 in alternate embodiments.

The number of, positioning, size, and orientation of the retainer strips 34 may vary in different embodiments. In some embodiments, only a single retainer strip 34 may be utilized. The scope of the present invention should not be construed as limited by the exemplary figures as to the number of, positioning, size, and/or orientation of the retainer strips 34.

C. Panels

As shown throughout the figures, a plurality of panels 40 are provided which are adapted to be removably connected to the sidewall 20 either before or after the sidewall 20 has been connected to the structure 12. The number of panels 40 will vary in different embodiments due to varying sizes and shapes of the sidewall 20. In some embodiments, only a single panel 40 may be utilized.

Generally, the panels 40 will each comprise a rectangular strip of material adapted to be removably connected to the sidewall 20 and to removably receive any number of decorative attachments 50. The shape, size, and orientation of the panels 40 will vary in different embodiments and should not be construed as limited by the exemplary figures.

As shown in FIGS. 2-4 and 6-7, the panels 40 will each comprise an outer surface 42 and an inner surface 42. The inner surface 43 of the panels 40 is adapted to be removably connected to the sidewall 20. Each panel 40 includes at least one connector strip 45 which is adapted to removably engage with a corresponding retainer strip 34 on the sidewall 20 to removably secure the panel 40 to the sidewall 20. The figures illustrate each panel 40 having one retainer strip 34, though additional retainer strips 34 may be included on panels 40 for added stability when in use.

The connector strips 45 may comprise adhesive strips or hook-and-fastener loop strips extending across the panels 40. The connector strips 45 may extend horizontally as shown in the figures, or may extend vertically or diagonally in other embodiments so long as they are capable of matching up with corresponding retainer strips 34 on the sidewall 20.

Figure 6:
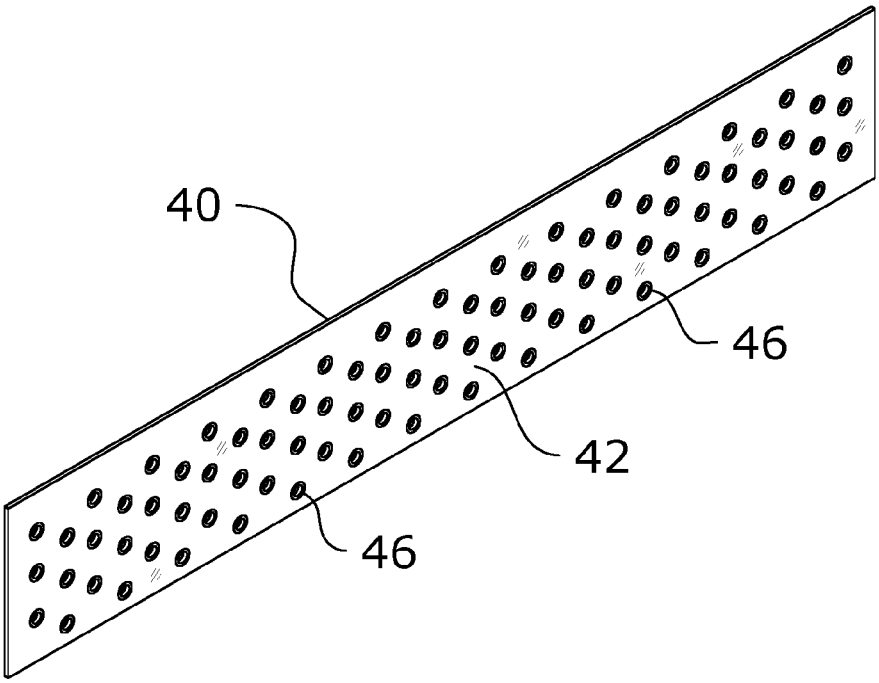
FIG. 6 is an upper perspective frontal view of a panel.
Figure 7:
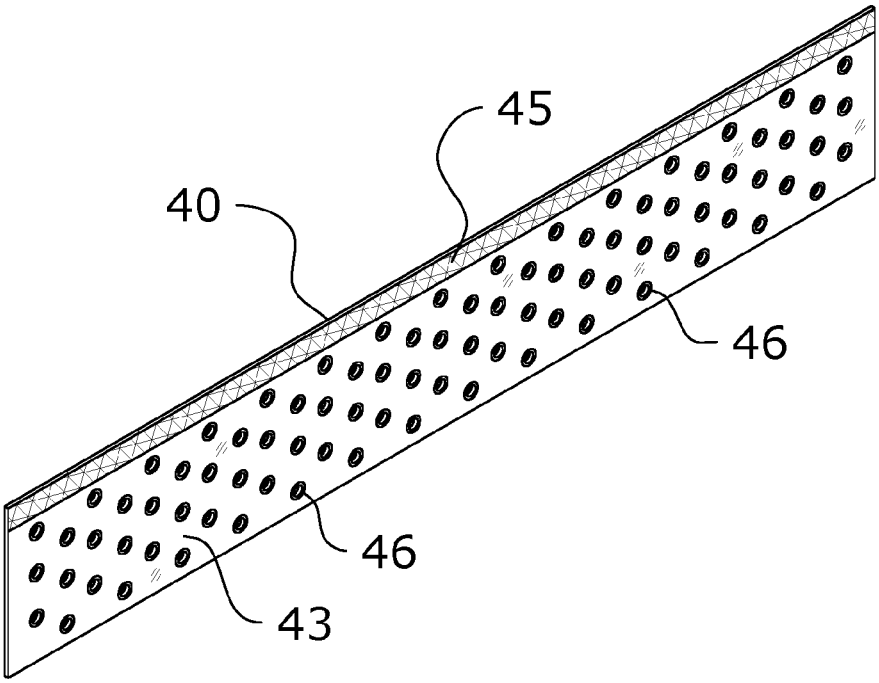
FIG. 7 is an upper perspective rear view of a panel.
Figure 8:
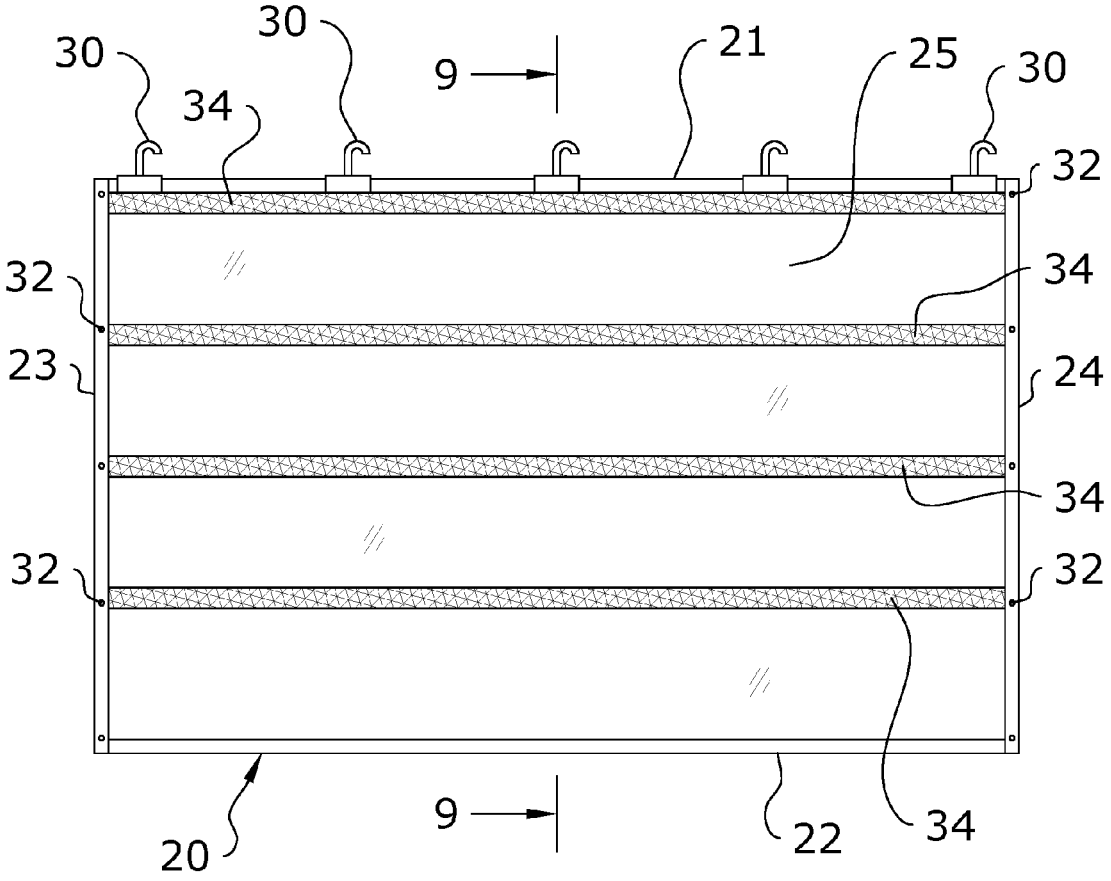
FIG. 8 is a frontal view of a sidewall.
Figure 9:
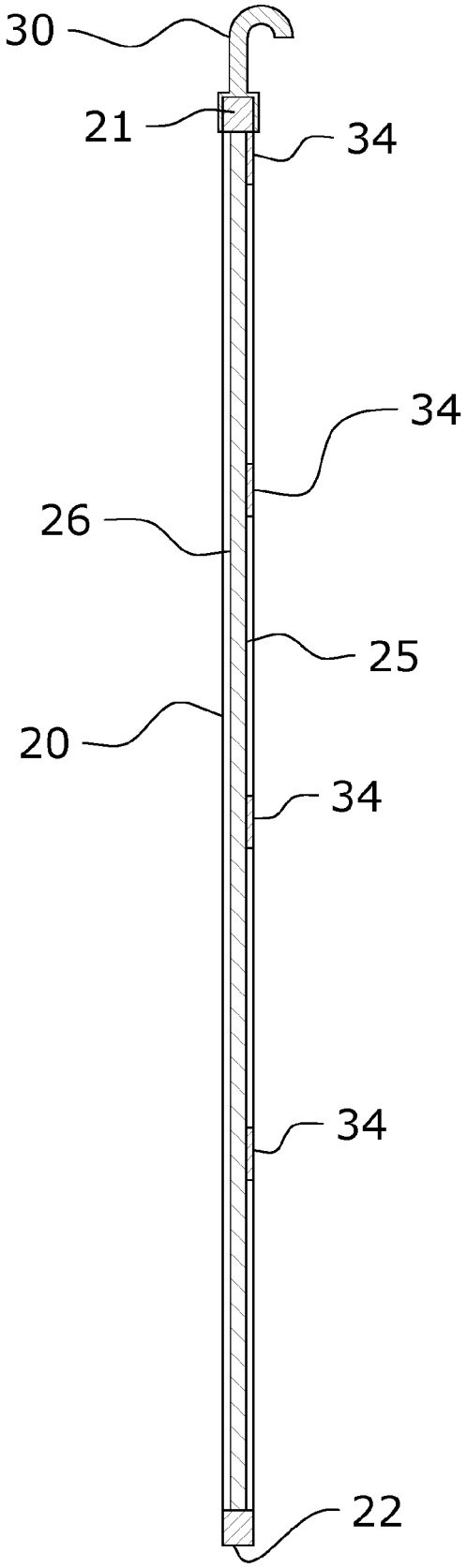
FIG. 9 is a side sectional view of a sidewall.
Figure 10:
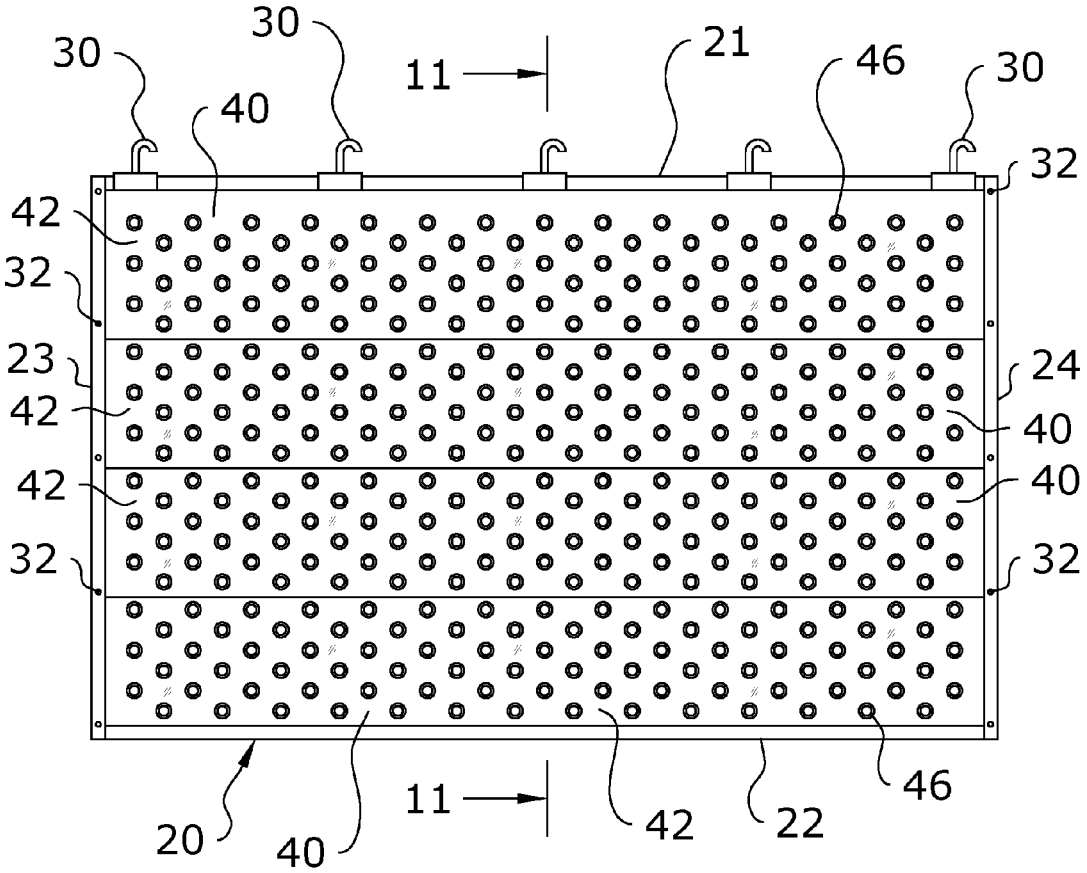
FIG. 10 is a frontal view of a sidewall covered in panels.
Figure 11:
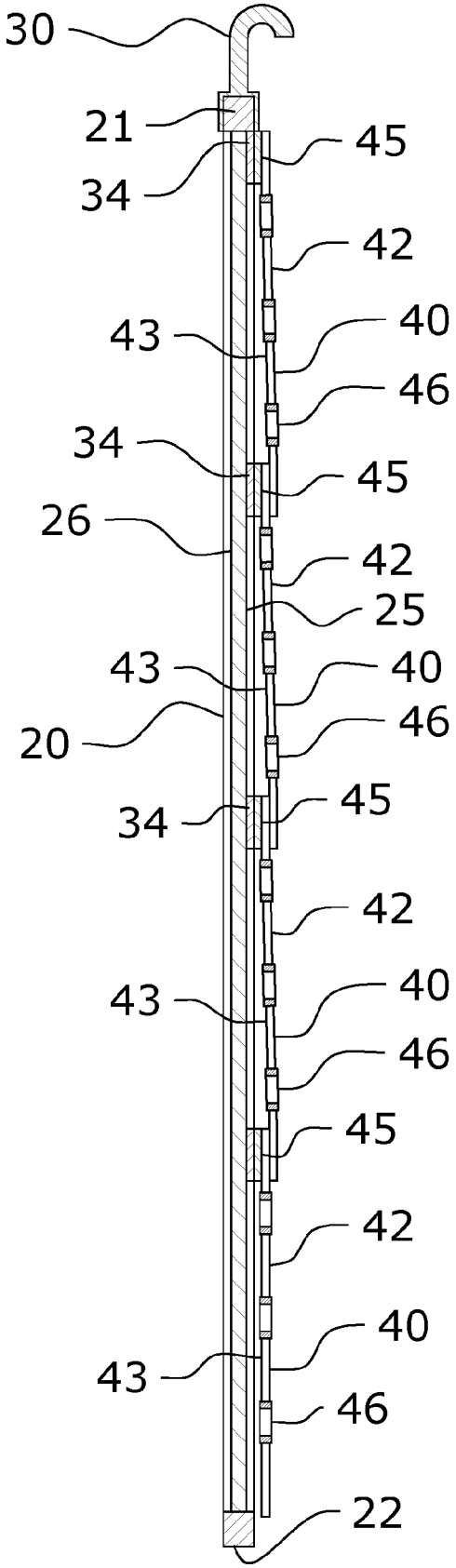
FIG. 11 is a side sectional view of a sidewall with attached panels.

As shown in FIGS. 6-7, a plurality of openings 46 extend into the panels 40. The openings 46 may extend into the outer surface 42, the inner surface 43, or both. The openings 46 act as grommets 46 to which the decorative attachments 50 may be removably connected. The number of, positioning, size, and orientation of the openings 46 may vary in different embodiments and should not be construed as limited by the exemplary figures. In the embodiments shown in the figures, the openings 46 are arranged in a grid-like orientation across the panel 40. The openings 46 may substantially cover the panel 40 as shown in the figures, or may only cover parts of the panel 40 in other embodiments.

D. Attachments

The panels 40, which are removably connected to the structure 12, are adapted to removably receive any number of decorative attachments 50. Various types of decorative attachments 50 may be utilized. In the exemplary figures, the decorative attachments 50 are shown as comprising flowers which may be connected to the openings 46 of the panels 40 to create a pleasing sidewall 20 for the structure 12.

E. Operation of Preferred Embodiment

In use, the sidewall 20 is first connected to the structure 12. The upper end 21 of the sidewall 20 may first be connected to the structure 12, following by the sides 23, 24 of the sidewall 20. To secure the upper end 21 of the sidewall 20 to the structure 12, the mounts 30 on the upper end 21 of the sidewall 20 are positioned to extend over the upper edge of the structure 12 to engage therewith such as shown in FIG. 1. To secure the sides 23, 24 of the sidewall 20 to the structure 12, cords, ropes or the like will be extended through the apertures 32 of the sidewall 20 and secured around a part of the structure 12 as shown in FIG. 1.

With the sidewall 20 secured to the structure 12, the panels 40 may be added to the sidewall 20. FIG. 2 illustrates a panel 40 being aligned to removable connection to the structure 12. The connector strip 34 of the panel 40 is aligned with one of the retainer strips 34 of the sidewall 20. The panels 40 may be secured to the sidewall 20 by engaging the retainer strips 34 and the connector strips 34 together in removable relationship. FIG. 3 shows panels 40 being connected to the sidewall 20. Preferably, the entire sidewall 20 will be covered with panels 40 as shown in FIG. 4.

Figure 4:
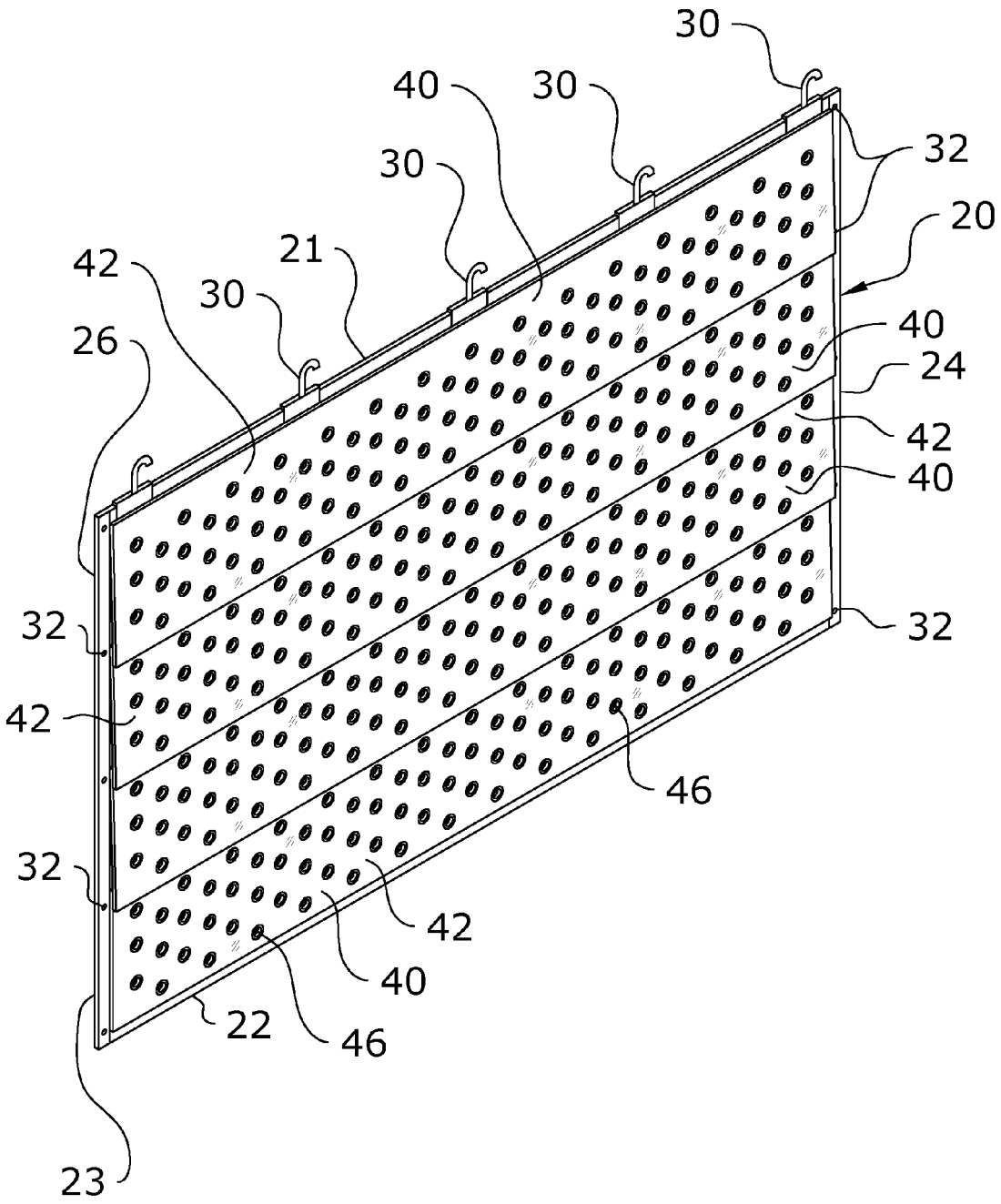
FIG. 4 is an upper perspective view of a sidewall covered in panels.

With the panels 40 covering the sidewall 20 as shown in FIG. 4, the decorative attachments 50 may be mounted to the panels 40. Each decorative attachment 50 will be removably secured with one or more openings 46 of the panel 40. Some decorative attachments 50 may require multiple openings 46 and some decorative attachments 50 may only require a single opening 46.

Figure 5:
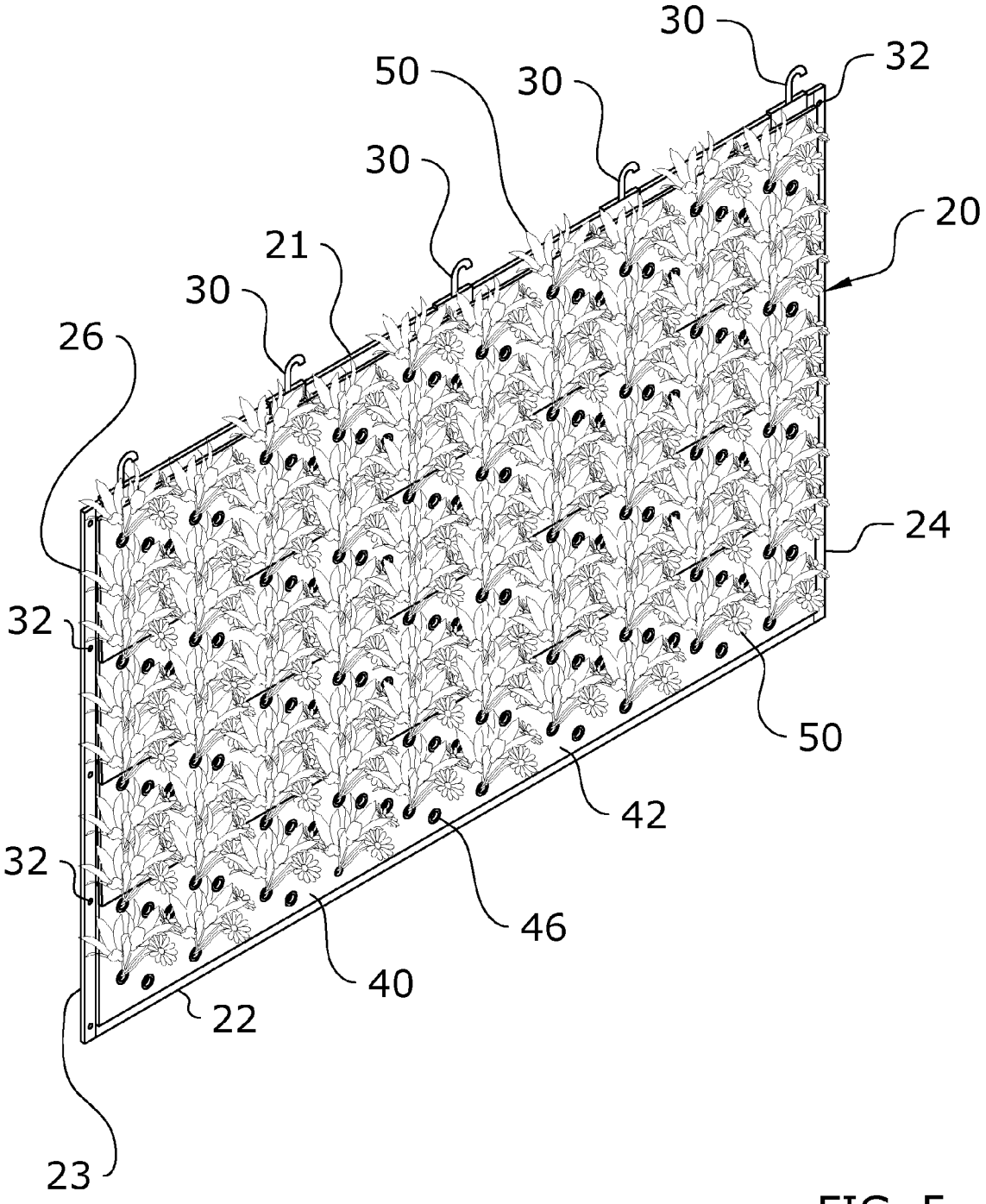
FIG. 5 is an upper perspective view of panels being covered with decorative attachments.

FIG. 5 illustrates the panels 40 of a sidewall 20 being covered in decorative flowers 50. Although the entire surface of the sidewall 20 is shown as being covered, in some embodiments only some of the panels 40 may be covered, leaving portions of the sidewall 20 uncovered. In such a manner, various designs may be created by selectively attaching decorative flowers 50 to only select portions of the panels 40.

Unless otherwise defined, all technical and scientific terms used herein have the same meaning as commonly understood by one of ordinary skill in the art to which this invention belongs. Although methods and materials similar to or equivalent to those described herein can be used in the practice or testing of the sidewall attachment system, suitable methods and materials are described above. All publications, patent applications, patents, and other references mentioned herein are incorporated by reference in their entirety to the extent allowed by applicable law and regulations. The sidewall attachment system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A decorative side wall system, comprising:

a sidewall including an upper end, a lower end, a first side, and a second side;

a mount on the sidewall for connecting the sidewall to a structure;

a plurality of retainer strips extending across the sidewall;

a plurality of panels adapted to be removably connected to the sidewall, wherein each of the panels comprises a plurality of connector strips for removably engaging with the plurality of retainer strips to removably connect each of the panels to the sidewall, wherein each of the panels extends between the first side and the second side of the sidewall, wherein the panels are connected parallel to each other, wherein the panels cover the sidewall from the upper end to the lower end; and a plurality of openings on each of the panels, each of the openings being adapted for removably receiving a decorative attachment, wherein the openings substantially cover each of the panels, wherein the openings are arranged in a grid-like orientation across each of the panels.

2. The system of claim 1, wherein the mount is on the upper end of the sidewall.

3. The system of claim 1, wherein the mount comprises a hook.

4. The system of claim 1, wherein the mount comprises a plurality of mounts extending across the upper end of the sidewall.

5. The system of claim 1, wherein the retainer strips extend between the first side and the second side of the sidewall.

6. The system of claim 1, wherein the retainer strips extend in parallel relationship.

7. The system of claim 1, wherein the first side and the second side of the sidewall each include a plurality of apertures for removably securing the first side and the second side of the sidewall to the structure.

8. The system of claim 1, wherein the retainer strips comprise strips of hook-and-fastener loops.

9. The system of claim 1, wherein the connector strips are positioned on an inner surface of the panel.

10. The system of claim 1, wherein the connector strips comprise strips of hook-and-fastener loops.

11. The system of claim 1, wherein each of the plurality of panels comprises a rectangular shape.

12. The system of claim 1, wherein the openings comprise grommets.

13. The system of claim 1, wherein the decorative attachment comprises a decorative flower.

14. A decorative side wall system, comprising:

a tent;

a sidewall including an upper end, a lower end, a first side, and a second side;

a plurality of mounts on the sidewall for connecting the sidewall to the tent;

a plurality of retainer strips extending across the sidewall;

a plurality of panels adapted to be removably connected to the sidewall, wherein each of the panels comprises a plurality of connector strips for removably engaging with the plurality of retainer strips to removably connect each of the panels to the sidewall, wherein each of the panels extends between the first side and the second side of the sidewall, wherein the panels are connected parallel to each other, wherein the panels cover the sidewall from the upper end to the lower end; and a plurality of openings on each of the panels, each of the openings being adapted for removably receiving a decorative attachment, wherein the openings substantially cover each of the panels, wherein the openings are arranged in a grid-like orientation across each of the panels.

15. The system of claim 14, wherein the mounts extend across the upper end of the sidewall.

16. The system of claim 14, wherein the first side and the second side of the sidewall each include a plurality of apertures for removably connecting the first side and the second side of the sidewall to the tent.

17. The system of claim 14, wherein the decorative attachment comprises a decorative flower.

18. The system of claim 14, wherein the sidewall is adapted to be removably connected to an outer wall of the tent.

* * * * *